United States Patent [19]

Garber et al.

[11] Patent Number: 4,901,539

[45] Date of Patent: Feb. 20, 1990

[54] ICE MAKING AND DISPENSING MACHINE

[76] Inventors: Howard A. Garber, 1900 Lauderdale Dr., Apt. D-109, Richmond, Va. 23233; William R. Knutson, 10607 Fiesta Rd., Fairfax, Va. 22032

[21] Appl. No.: 302,951

[22] Filed: Jan. 30, 1989

[51] Int. Cl.[4] ..... F25C 1/12

[52] U.S. Cl. ..... 62/306; 62/352; 62/356

[58] Field of Search ..... 62/340, 306, 348, 352, 62/356

[56] References Cited

U.S. PATENT DOCUMENTS

| | | | |
|---|---|---|---|
| 2,361,137 | 10/1944 | Terry et al. | 62/306 X |
| 2,572,508 | 10/1951 | Muffly | 62/352 X |
| 2,682,160 | 6/1954 | Kromer | 62/306 X |
| 2,718,123 | 9/1955 | Braswell, Jr. | 62/352 X |
| 3,477,244 | 11/1969 | Scoggins | 62/306 |
| 3,823,571 | 7/1974 | Smith et al. | 62/352 X |
| 4,161,108 | 7/1979 | Cope | 62/306 |
| 4,625,525 | 12/1986 | Bradbury et al. | 62/340 X |
| 4,687,120 | 8/1987 | McMillin | 62/306 X |

*Primary Examiner*—William E. Tapolcai

[57] ABSTRACT

An ice making and dispensing machine comprising a chamber for holding a layer of ice particles floating in water held at approximately freezing temperature, a remote dispensing head, an external freezing coil evaporator for freezing water into particulate ice forms, a pump disposed at the surface of the ice-water mixture for moving the mixture to the remote dispensing head, a system of conduits through which the mixture is circulated to the remote dispensing head, a return water pump with appropriate control mechanism and control mechanism with combination manual and electric control variable low-rate dispensing valves and operators, suitable for use with computer circuitry for delivering the ice, soda and syrups through the dispensing head directly into the beverage glass, pitcher or other container.

5 Claims, 5 Drawing Sheets

ICE MAKING AND DISPENSING MACHINE

BACKGROUND OF THE INVENTION

This invention relates to ice making and more particularly to ice makers for producing pieces of disc shaped ice submerged in a tank of water held at a temperature near freezing. This water becomes the storage medium for the commonly called ice cubes.

This invention employs an external coil evaporator utilizing a liquid refrigerant for freezing and its hot gas state to effect harvesting. External evaporators have previously been employed for producing ice uner water.

An improvement over present coils by the herein disclosed evaporator is the unique configuration of the coil which lends it to lower cost for fabrication and ease of maintenance.

The deformation of the evaporator coil is accomplished by a mechanical press. The coil then is applied to the exterior of the storage tank by clamping, thus eliminating all soldering procedures.

Other methods of attaching the coil to the exterior of the storage tank such as spot welding, cold soldering or similar methods is recognized herewith and considered as common to the art.

The interior freezing surfaces are readily available for cleaning by removing the enclosing head unit and its various components. This configuration provides for a highly compact arrangement which is efficient in initial cost for construction, space requirements for the several elements and also for the energy requirements needed to effect heat transfer from the stored water.

Ice dispensing machines are well known to the art. Most of these devices deliver the ice from a delivery spout attached to the machine. This in many cases is an inconvenience in that a bulky machine or storage bin is required in a convenient location to the user. Often valuable counter space is sacrificed for this equipment.

An improvement over this arrangement is provided by the design of a remote dispensing head requireing comparatively little counter space.

The two embodiments of this invention provide for a compact ice making machine and dispensing head, constructed essentially as set forth in the Abstract, the dispensing head being incorporated in the machine and all suitable for installing in a serving counter line.

SUMMARY OF THE INVENTION

An ice making machine is provided which utilizes an evaporator coil constructed of any suitable material in tubing form which is flattened at intervals and deformed so as to bring these flattened portion of the coil into contact with the exterior surface of the ice/water storage tank. Pure ice cubes are formed on the interior surface of the storage tank at these contact points. The area of these contact points determines the shape and size of the ice cubes. A refrigerant is circulated through this coil until ice of the desired thickness is formed. Upon application of the hot gas harvesting cycle the cubes float to the surface of the water in the storage tank. A circulating pump, located at the surface of the ice/water mixture provides the means for delivering the mixture, by constant circulation, through insulated conduits to the remote dispensing head or heads. When ice is required at any dispensing head a diverter valve is actuated from the head and a controlled quantity of ice is dispensed. The remaining ice/water mixture is returned to the freezing compartment of the ice making machine via a return insulated conduit.

A syrup storage compartment is provided. Syrup is transported through suitable small bore tubing held in contact with the ice/water mixture conduits, thus effectively chilling the syrup as it is delivered to the remote dispensing head. This dispensing head is designed with manual/electric dispensing control valves for ice and syrup dispensing. The electric element of the control valves is designed for use with computer circuitry.

In the first embodiment of the invention the pure ice cubes are formed as set forth in the basic disclosure and the ice/water circulating pump is utilized. The remote dispensing head is replaced by an integral head constructed within the machine cabinet. Internal conduits for transporting the ice/water mixture from the storage tank to the dispensing head are incorporated and the external ice/water conduits are eliminated. The dispensing head is contructed and used as set forth in the basic disclosure.

In the second embodiment of the invention the ice cubes are formed as set forth in the basic disclosure and the ice/water mixture pump is eliminated by the use of carbon dioxide gas to pressurize the ice/water mixture in the storage tank. This produces a carbonated ice/water mixture being suitable for use in the finished beverage is delivered to the dispensing head by pressure of the carbonating gas. A motor driven agitator is utilized for effecting complete carbonation of the stored water. The dispensing head is as set forth in the basic disclosure.

DETAILED DESCRIPTION OF THE PREFERRED EMBODIMENTS

Figure 1:
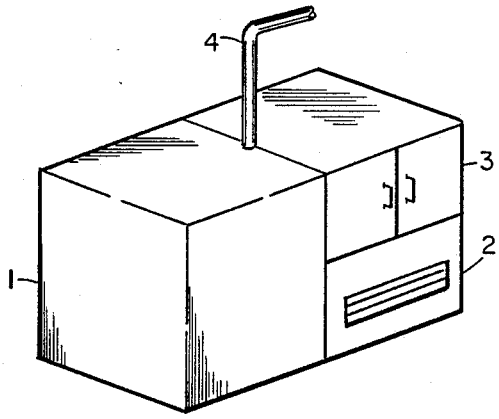
FIG. 1 is an isometric view of an ice making machine embodying various features of the present invention.
Figure 2:
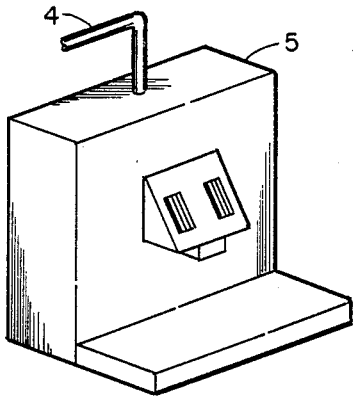
FIG. 2 is an isometric view of a remote dispensing unit for use with the ice making machine shown in FIG. 1.
Figure 3:
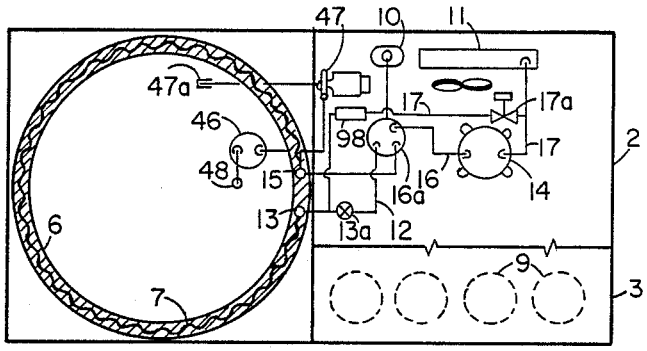
FIG. 3 is a sectional plan of the ice making machine taken generally along the line 1—1 of FIG. 4.

Illustrated isometrically in FIG. 1 is an ice making machine comprised of an ice making compartment a compressor compartment 3. Ice/water mixture and syrup conduits 4 are provided for conveying the ice/-water mixture and syrup to the remote dispensing unit 5 of FIG. 2. Shown diagrammatically in FIG. 3 is the insulated ice/water mixture storage container 6, the ice forming evaporator 7, syrup storage compartment 3 disposed above the compressor compartment 2, syrup containers 9, and a refrigeration system, better seen in FIG. 4, consisting of a receiver 10 which collects the liquid refrigerant from the condenser 11 and supplied it through refrigerant line 12 to liquid header 13 of the evaporator 7. All refrigerated lines are provided with thermal insulation.

A suitable refrigerant compressor 14 draws refrigerant gas from the suction header 15 of the evaporator 7 through refrigerant suction line 16 and heat exchanger 16*a* and delivers high pressure refrigerant gas through gas line 17 to condenser 11 producing liquid refrigerant in receiver 10. During the freezing cycle this liquid is circulated through liquid line 12 to heat exchanger 16*a* and then to liquid header 13 of evaporator 7 through expansion valve 13*a*.

During the defrost cycle hot gas solenoid valve 17*a* is opened allowing the hot gas to pass directly to the liquid header 13. A resistance heater 98 is provided in contact with the hot gas line 17 to produce sufficient heat to complete the defrost cycle.

Figure 4:
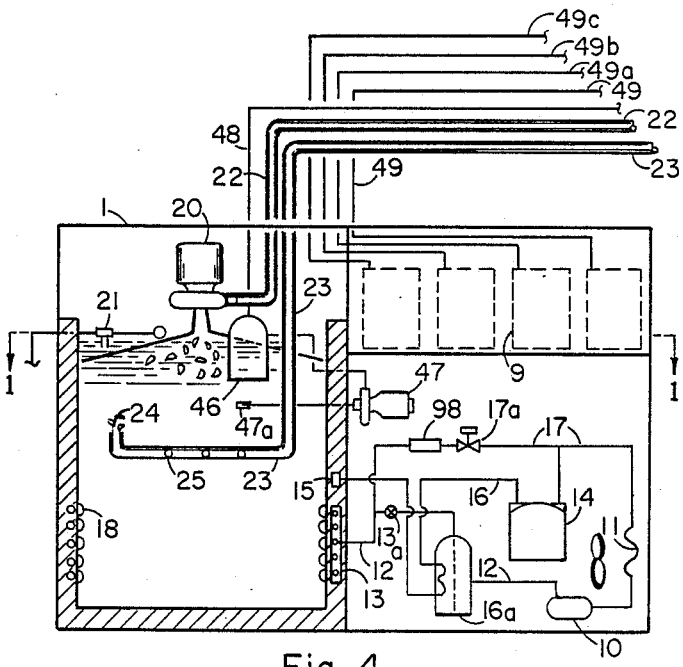
FIG. 4 is a vertical sectional view taken generally along the line 2—2 of FIG. 3.
Figure 28:
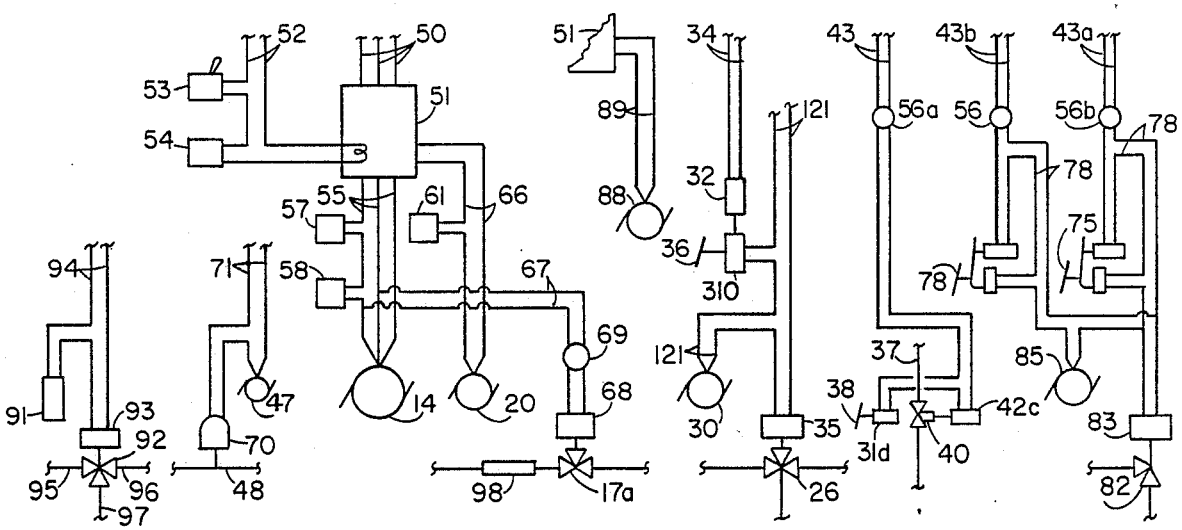
FIG. 28 is a schematic electrical diagram showing control wiring of the various components of the basic invention and the two embodiments.

The hot gas valve 17*a* is actuated by a suitable timer 56 shown in FIG. 28, which senses the lapsed time of the freezing cycle to actuate the opening of the hot gas solenoid operated valve 17*a* and energizing heater 98, FIGS. 3, 4 and 28, to provide heat to effect the defrost cycle.

Figure 5:
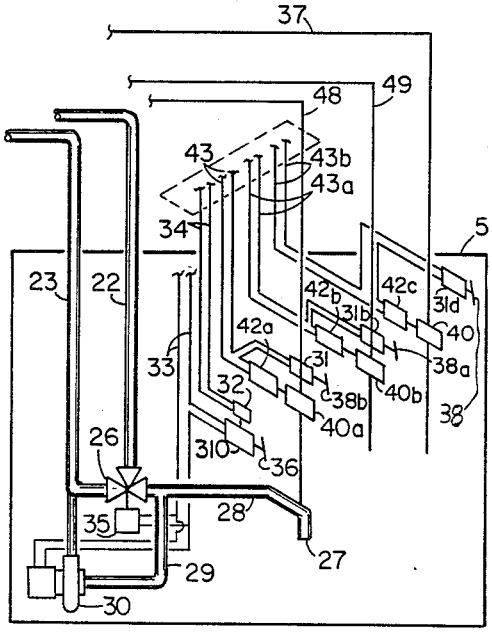
FIG. 5 is a schematic view of ice/water conduits and syrup conduits connecting the ice making machine to the remote dispensing unit. Also shown is the three-way diverter valve used to divert the ice/water mixture flow either to the dispension head or back to the ice making machine. A return water pump for pumping drained chilled water back to the ice making machine is shown. Also shown is an electrical schmatic view of the control circuitry for operating the diverter valve, return chilled water pump and the syrup valves.
Figure 6:
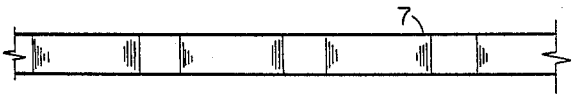
FIG. 6 is a sectional elevation view of the freezing coil.
Figure 7:
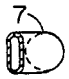
FIG. 7 is a cross section view of the coil taken on the line 3—3 of FIG. 8.
Figure 8:
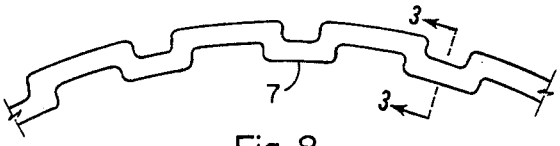
FIG. 8 is a partial view of the freezing coil.
Figure 9:
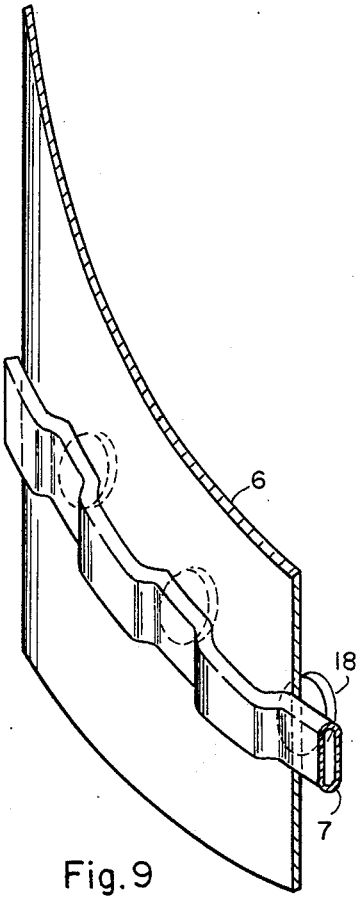
FIG. 9 is an isometric view of a section of the freezing coil applied to the exterior surface of the ice/water storage tank.
Figure 12:
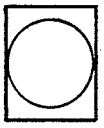
FIG. 12 is a front view showing the spring return operator of this valve.
Figure 10:
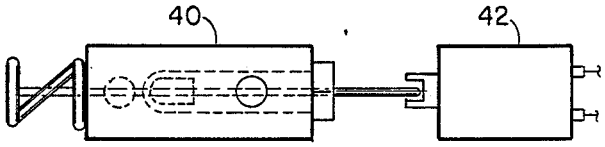
FIG. 10 is a plan view of the manual/electrical variable flow-rate control valve and the associated electric operating solenoid for dispensing water, soda water, syrup, alcoholic beverages and other liquids.
Figure 11:
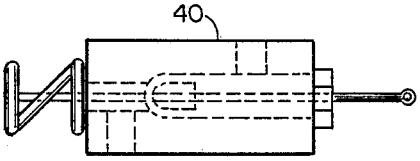
FIG. 11 is a side view of the manual/electric variable flow-rate valve.
Figure 13:
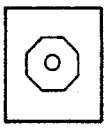
FIG. 13 is a rear view of the valve showing the connecting rod for attaching the electrical operating solenoid.
Figure 14:
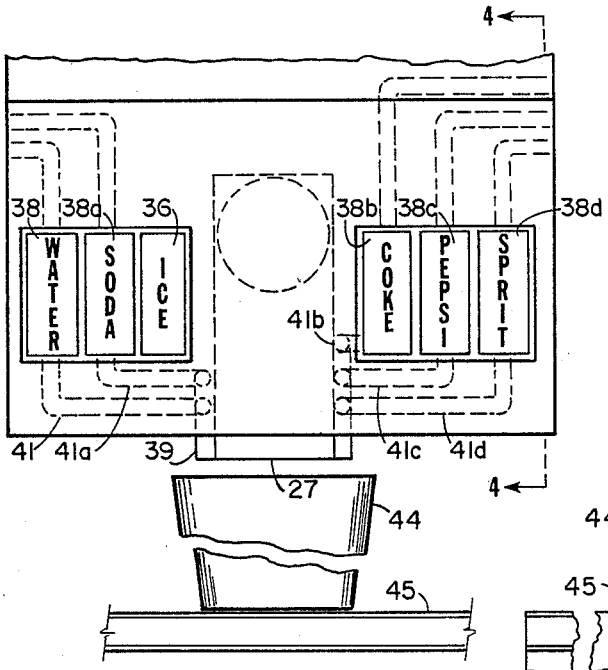
FIG. 14 is a front elevation view of the operating panel showing the disposition of the manual operating levers of the dispensing valves, the ice delivery chute and liquid dispensing tubing. Also shown is the location of the beverage container and the conveyor belt.
Figure 16:
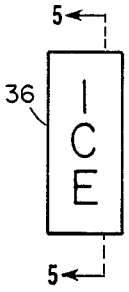
FIG. 16 is a front view of manual operating lever for the control mechanism for ice dispensing.
Figure 17:
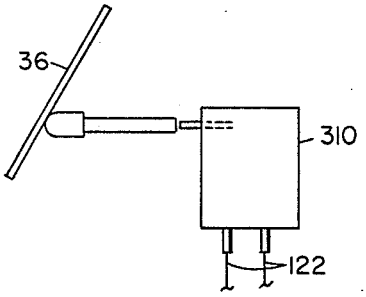
FIG. 17 is a sectional view of the complete control mechanism of the manual/electric operating devices taken generally along line 5—5 of FIG. 16.

During the defrost cycle when the hot gas flows through the evaporator, heat melts the icebond between the ice and the internal surface of the storage tank 6 allowing the formed internal surface of the storage tank 6 allowing the formed ice cubes 18 to float to the surface of the water storage tank 6 thus forming the ice/-water mixture. The level of this water is maintained by automatic operation of float valve 21. A circulating ice/water pump and motor 20 is mounted in such a position that the intake of the pump is slightly submerged in the mixture. The mixture is circulated continuously through heat insulated conduits 22 and 23 during periods of activation of the refrigeration compressor 14. Conduit 23 is the return conduit which returns the ice/-water mixture to the storage tank through ice restrictor nozzle 24 and water nozzle 25. As the return water is passed through nozzle 25 the velocity is increased sufficiently to cause circulation of the water across the freezing surface of the internal wall of the storage tank, thus removing impurities from the freezing ice cubes and insuring a pure water ice cube supply. The circulating ice/water mixture is circulated through conduit 22 to the three-way diverting valve 26 located in the remote dispensing unit 5 and diagrammatically shown in FIG. 5. This valve in a normal position returns the circulating ice/water mixture into conduit 23 and thus back to the ice-making compartment of the ice making machine. When ice is required at the remote dispensing head 27 the activation of its controls shown in detail in FIGS. 16 and 17 and described below, causes the diverter valve to move from the normally closed position to the delivery position thus feeding the ice/water mixture to the dispensing head conduit 28, FIG. 5. As this mixture moves through this conduit it passes over open drain 29 allowing the water to drain free leaving only ice cubes to be delivered to the dispensing head 27. A chilled water return pump 30 is provided to recover chilled water discharged to drain. Controls for this pump are shown in FIGS. 5, 14 and 28. Also shown in FIGS. 3 and 4 is a soda water compression tank 46, pump and motor 47 and soda delivery tubing 48, all of which delivers soda water through dispensing valve 40*a*. Suction tubing to pump 47 is provided with strainer 47*a*. Control for the soda water pump is as shown in FIG. 28 and consists of a pressure operated on-off controller 70. Syrup lines 49, 49a, 49b and 49c, FIG. 5 deliver syrup from the pressurized storage tanks 9, through the dispensing valves 40b, FIG. 5 and similar ones not shown, to dispensing chute 27 through tubing 41b, 41c and 41d, FIG. 15.

Figure 15:
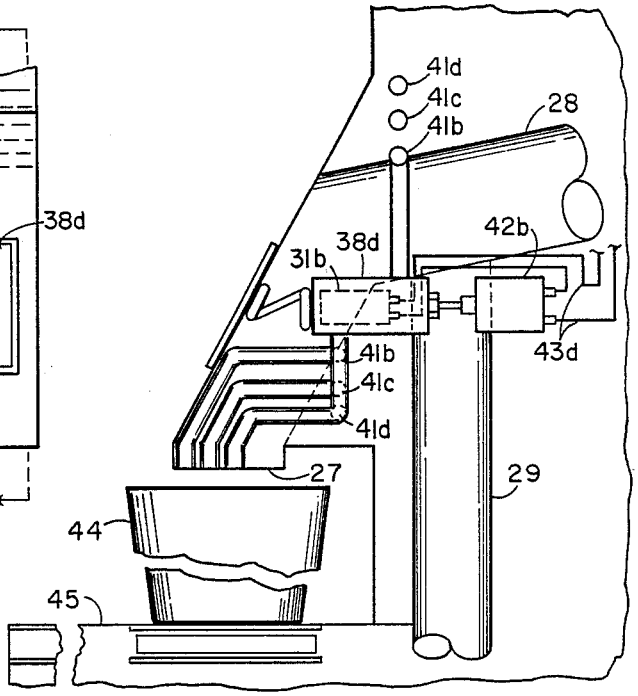
FIG. 15 is a sectional view taken generally along lines 4—4 of FIG. 14.

Controls associated with the operation of the ice dispensing chute 27 are shown in FIGS. 5, 15, 28 and 32 and consist of a manually operated lever 38a, a manual/electric delayed action switch 31b, electrical conduits 43d, computer control 42b and computer electrical conduit 43a, FIGS. 5 and 15. When electrical delayed action switch 31b is closed for ice delivery the diverter valve operator 35 is activated to divert the ice/water mixture through conduit 28 to dispensing chute 27. The water is drained through tube 29.

The syrup, soda, alcohol beverage and drinking water have associated controls as described below:

Manual operating levers 38, 38a, 38b, 38c and 38d, FIG. 5 are provided for operating delayed action electrical switches 31, 31b and 31d which operate variable flow-rate valves 40, 40a and 40b, which disperse the respective liquids through suitable tubing 41, 41a, 41b, 41c and 41d, shown in FIGS. 14 and 15.

When computer controls 42, 42a, 42b, 42c and 42d are operated through computer electrical conduits 43a, 43b and 43c the desired liquid syrup, soda, alcohol beverage or water is dispensed through their respective tubes 41, 41a, 41b, 41c and 41d located at the dispensing head.

In FIGS. 14 and 15 beverage container 44 is disposed beneath the dispensing head. A conveyor belt 45 is shown as an optional adjunct.

Control circuits for the various elements of the basic invention are shown diagrammatically in FIG. 28 and described below.

An external source of suitable electrical current is conducted through electrical conductors 50 to contactor 51. When control circuit 52 is energized by operating manual on-off switch 53, and low water ice/water storage tank cut-off switch 54 is in the "on" position contact points of the contactor 51 are pulled into contact, the compressor circuit 55 is energized thus operating compressor motor 14 through high pressure cutout switch 57 and low pressure switch 58. The compressor operates continuously under control of the low pressure switch and is protected from damage by automatic operation of the high pressure switch 57. Ice/water circulating pump 20 is energized through electrical conductor 66 and motor over-load circuit breaker 61 when contact points of contractor 51 are contacted. The above control sequence controls the freezing cycle. The ice harvesting cycle is accomplished by operating the hot gas valve 17a and resistance heater 98, by energizing the hot gas valve operator 68 through time clock 69. Electrical energy is fed to circuit 67 during operation of the compressor.

Ice diverter valve operator 35 is supplied with a suitable source of electrical current through electrical conductor 121. In the manual mode when lever 36 is activated mini switch 310 allows current to flow to valve operator 35 which changes the valve 26 to the diverter position sending ice/water mixture to the delivery head. At the same time the chilled water return pump 30 is activated by current flow through extended electrical conductors 121. The drained chilled water is thus returned to the ice making machine.

Figure 32:
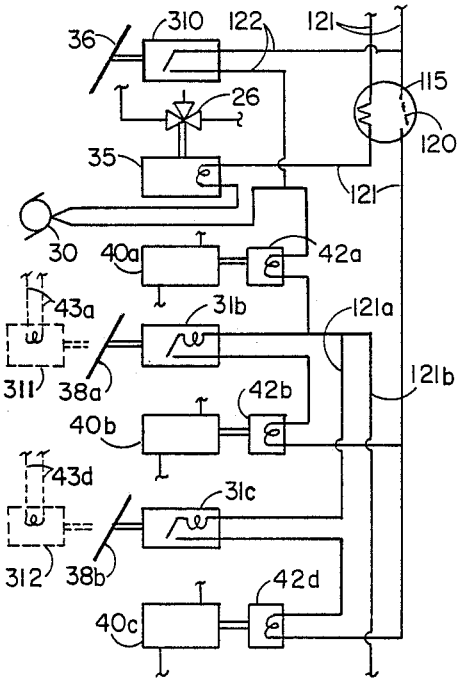
FIG. 32 is a diagrammatic presentation of the control system for the simultaneous dispensing of multiple beverage ingredients.

In the computer mode FIG. 32 a suitable electric signal current is sent from the computer through electrical conductors 43a through time clock 115 to solenoid operator 311. This then activated delayed action switch 31b repeating operation of the manual cycle under control of timer 115.

To effect the delivery of syrups, soda, alcohol beverages and water the associated valves 40, 40a and 40b are actuated by either manual or computer operation. It is noted that the invention includes any number of valves required for each class of function.

Figure 31:
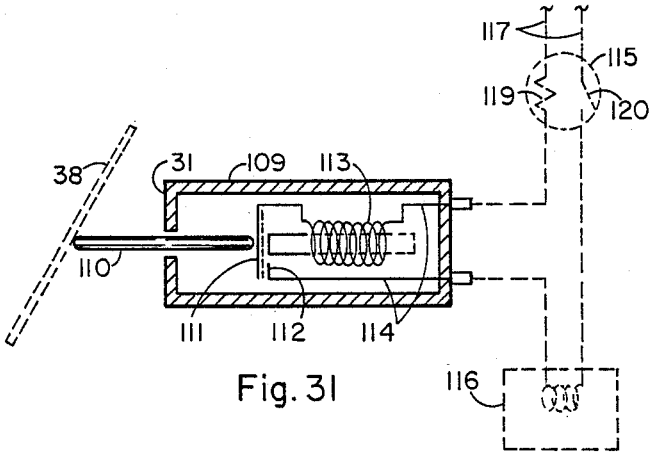
FIG. 31 is a longitudinal section view of a delayed action electrical switch.

When manual operations 38, 38a and 38b are depressed their respective delayed action switches 31, 31a and 31b are closed causing operation of the respective variable flow-rate dispensing valves 40, 40a and 40b. These valves are under automatic control of their preset time clocks. Upon their opening the desired liquid flows through tubing 37, 49, 49a, 49b or 49c to the dispensing head. Delayed action switch 31, FIG. 31, functions as follows:

When manual operator 38 is depressed movement is conveyed through pin 110 to cause blade 111 to make electrical contact with contactor 112 thus energizing holding coil 113 through conductors 114 internal of the body 109 of the switch and conductors 117 external of the switch. Also energized is the clock mechanism 119 of the normally closed timer 115 and the electrical operator 116 of the respective dispensing valve. The switch holding coil 113 maintains operation of the timer clock mechanism 119 until the desired lapsed time for each dispensing valve is obtained and automatically opens electrical switch 120 thus terminating the flow of the delivered product, ice, soda, syrup, etc. Time clock mechanism 119 of timer 115 is provided with a return spring to reset the timer to the starting time after each operation.

Figure 29:
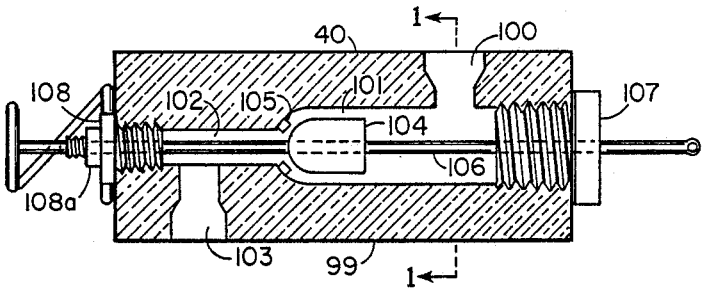
FIG. 29 is a sectional view of manually/electrically operated variable flow-rate dispensing valve 40, taken generally along line 2—2 of FIG. 30.
Figure 30:
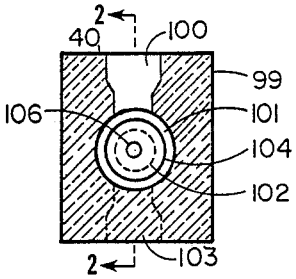
FIG. 30 is a sectional view of this same valve 40, taken generally along the line 1—1 of FIG. 29.

Dispensing valve 40 of FIG. 29 consists of a body 99, liquid passageways 100, 101, 102 and 103, a poppet 104, a seat 105, an activating rod 106, bushing elements 107 and 108 and adjusting mechanism 108a to vary the flow-rate. In the computer mode FIGS. 5 and 28, a suitable electric signal current is sent from the computer through electrical conductors 42, 42a or 43b through timeclock 56a, 56b or 56c to solenoid operator 42, 42a, 42b or 42c which opens the dispensing valve to dispense the liquid to the delivery head.

In FIG. 28 soda pump 47 is operated by utilizing a pressure switch 70 mounted on the soda water tubing 48. Upon a drop in pressure the pressure switch activates electrical circuit through electric conductor 71 and maintains operation of the pump until pressure is reestablished in the system.

Figure 18:
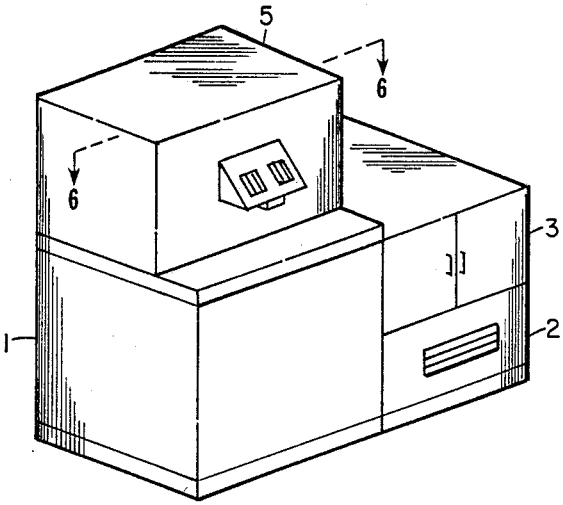
FIG. 18 is an isometric view of the two emebodiments designed for use in a serving counter line, the remote dispensing units being eliminated.
Figure 21:
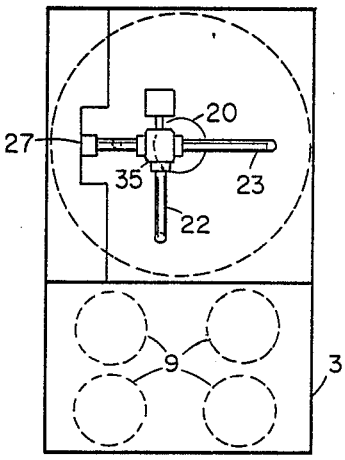
FIG. 21 is a sectional plan view taken generally along line 8—8 of FIG. 19.

In addition to the basic invention there is disclosed two embodiments both being shown in FIG. 18. Both embodiments in essence combine the remote dispensing head of the basic invention into the body of the ice making machine thus rendering it suitable for use in a counter serving line.

FIG. 18 is an isometric view of the machine consisting of an ice making compartment 1, a compressor compartment 2, a syrup storage compartment 3, and ice and beverage dispensing compartment 5.

Figure 19:
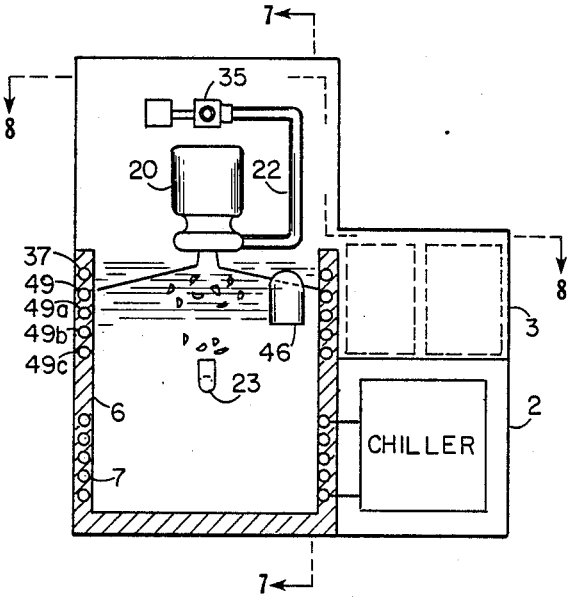
FIG. 19 is a sectional view of one embodiment taken generally along line 6—6 of FIG. 18.
Figure 20:
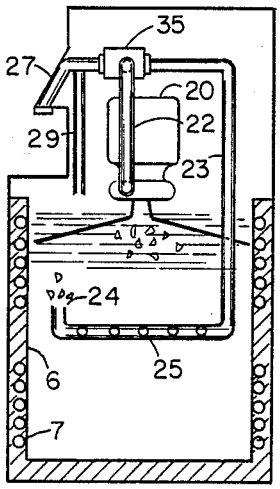
FIG. 20 is a sectional view taken generally along line 7—7 of FIG. 19.

FIG. 19 is a sectional view of the first embodiment of the machine taken generally along line 6—6 of FIG. 18. The construction of this embodiment is similar to the basic machine and incorporates the ice-water storage tank 6, external ice freezing evaporator 7, the complete refrigeration system marked CHILLER, syrup storage compartment 3, soda water tank 46 with its associated elements, the ice/water mixture circulating pump 20 and all tubing, dispensing elements including dispensing head 27, ice diverting valve 35, the ice/water mixture circulating tubing supply 22 and return 23.

The two major modifications of the basic machine to effect a compact unit as envisioned in embodiment one is a redesign of the ice/water tubing 22 and 23 so as to be completely contained within the cabinet of the machine and a change in the configuration of the syrup, soda, alcohol beverage and water tubing **37, 49, 49*a*, 49*b* and 49*c*** so that the cooling of these liquids is accomplished by disposing this tubing in contact with the external surface of the ice/water storage tank.

All controls are essentially similar to the controls for the basic unit except that the return chilled water pump is omitted. The return water returns directly by gravity to the ice/water storage tank through conduit 29.

Figure 22:
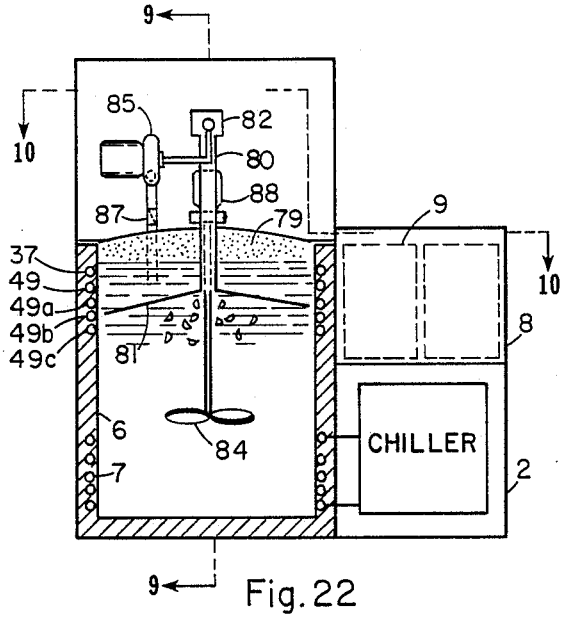
FIG. 22 is a sectional view of the second embodiment taken generally along line 6—6 of FIG. 18.
Figure 23:
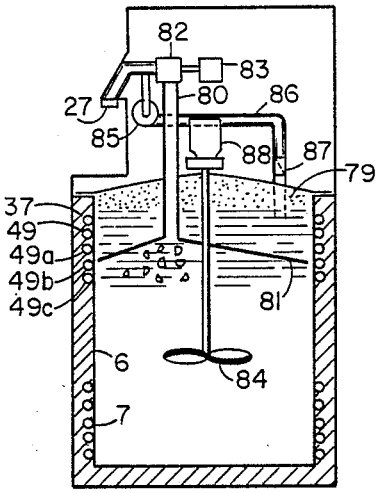
FIG. 23 is a vertical sectional view taken along line 9—9 of FIG. 22.

FIG. 22 is a sectional view of the second embodiment of the machine taken generally along line 6—6 of FIG. 18. The construction of this embodiment is an alteration of the basic unit in the following aspects:

The ice/water mixture storage tank 6 is designed as a closed pressure vessel and is provided with a layer of pressurized carbon dioxide gas 79. The ice/water mixture conveyor tube 80 connects the ice consentrating shield 81 to the control valve 82. When the control valve operator 83 is energized carbonized ice/water mixture is fed to the delivery head. This carbonized ice/water mixture is produced by the absorption of carbon dioxide gas into the ice/water mixture. This absorption is assisted by operation of agitator 84.

When ice only is required control lever 78, of FIG. 28 is depressed opening the flow control valve 82 through operator 83 and actuating chilled water return pump 85 to return the water through conduit 86 to the pressurized ice/water storage tank. Check valve 87 prevents back-flow of the ice/water mixture.

The syrup, soda, alcohol beverage and water tubing **37, 49, 49*a*, 49*b* and 49*c* is disposed around and in contact with the external surface of the ice/water storage tank 6** thus accomplishing the cooling of these liquids.

Agitator motor 88 is provided for operation of the agitator 84 and controlled through its electrical conductor 89, FIG. 28, being connected through contractor 51 to operate the agitator continuously during periods of operation of the refrigerant compressor 14.

Figure 25:
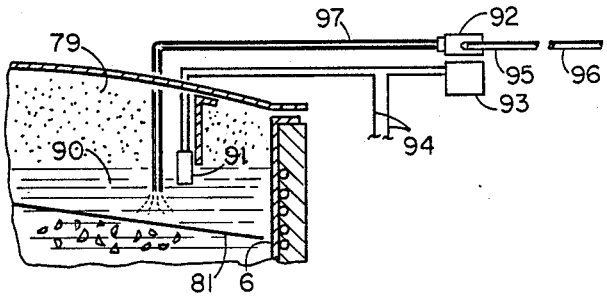
FIG. 25 is a partial sectional view of the upper portion of the storage tank taken generally along line 12—12 of FIG. 24 showing the control mechanism for the control of the carbon dioxide gas and the water level.
Figure 24:
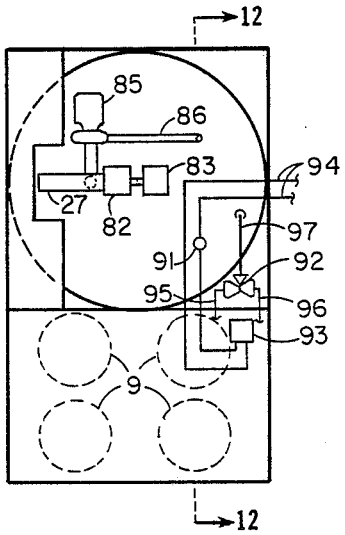
FIG. 24 is a plan view taken generally along line 10—10 of FIG. 22.
Figure 26:
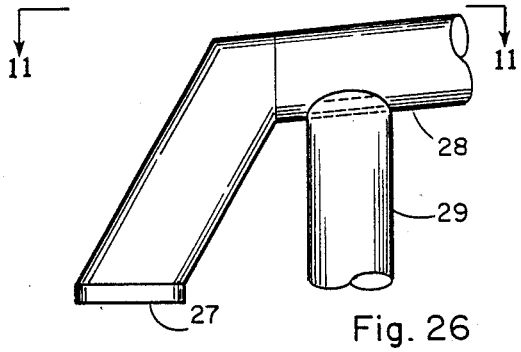
FIG. 26 is a side view of the ice discharger chute with water drain-off tube shown also in FIG. 15.
Figure 27:
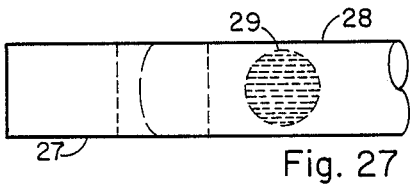
FIG. 27 is a plan view of the ice discharger chute with water drain-off tube.

Mechanism for maintaining carbon dioxide gas 79 for pressure and water level 90, FIGS. 24 and 25 consists of a float switch 91, a three-way valve 92, operator 93 and electrical conductors 94, shown in FIGS. 24, 25 and 28. Connected to the three-way valve are carbon dioxide gas tube 95, water tube 96 and common supply tube 97.

Carbon dioxide gas pressure is maintained constantly through carbon dioxide gas tube 95, to the open side of the three-way diverter valve 92 which maintains a set pressure within the ice/water storage tank. When water is required to maintain the water level the float switch 91 actuates the three-way diverter valve to its diverter side to which the water tubing 96 is connected. Water is then supplied through the common tube 97 to the ice/-water storage tank. When the water level is restored, three-way valve 92 is returned to its open position to maintain constant gas pressure.

When ice or ice/water carbonated mixture is required appropriate operating levers at the delivery head are actuated either manually or by computer to effect the proper dispensing. The dispensing is actuated by pressure of the compressed carbon dioxide.

The control system for the simultaneous dispensing of multiple beverage ingredients shown diagrammatically in FIG. 32 operates as follows:

Suitable electrical current is supplied to normally closed time clock 115 through conductors 121. Description and operation of this clock is given under delayed action switch shown in FIG. 31. Upon activation of delayed action switch **31*b* by manual operation of member 38*a* or computer operation through conductors 121 to any number of dispensing valve operators. For clarification only, and not to be taken as a restriction of the scope of this control system, these valve operators are designated 42*b* for dispensing one flavor of syrup through variable flow-rate valve 40*b*, 42*a* for dispensing soda water through variable flow-rate valve 40*a* and 35 for dispensing ice through diverter valve 26. Delayed action switch 31*b* maintains electric current to all operators for a preset time period. Upon reaching this time period, time clock 115 opens its normally closed circuit through its switch 120 thus allowing each operator to return to its close position closing all dispensing valves. Activator 38*b* manual and 312 computer, activate through conductor 121*a* a second flavored syrup dispensing valve and the soda and ice dispensing valves. Conduit 121*b*** carries operating current to similar operators and dispensing valves.

A manually operated mini switch 310 is activated through manual operator 36 which activates diverter valve 26 to deliver ice to bulk containers such as pitchers, bowls and similar utensils.

Having thus described the invention what is claimed and desired secured by Letters Patent is:

1. An ice making and dispensing machine comprising in combination an enclosing cabinet, a water tight container constructed of high thermal transmitting material, pressurized syrup storage containers, a refrigerating system including evaporator comprising metalic tubing having multiple contact points configured to contact the outer surface of said water tight container, said water tight container being filled with water, said evaporator by means of heat transfer to produce a plurality of pure ice cubes being circular in form and having a slight convex surface adjacent to the side wall of the water tight container upon which they form and a greater convex surface on the opposite side due to ice build up as the cubes grow to any desired thickness, a means for providing a harvesting cycle consisting of an intermittently applied hot gas flow through said evaporator causing the ice cubes to relese from the interior side wall and float to the surface of the contained water producing an ice/water mixture, conduits consisting of tubing located externally of the enclosing cabinet, a means for circulating separately the ice/water mixture and syrup through the said external conduits, a remote dispensing head consisting of an enclosing cabinet which encloses variable flow-rate dispensing valves and attending actuating members, a control system providing for the simultaneous dispensing of multiple beverage ingredients, a delivery chute consisting of tubing extending downward from said enclosing cabinet at a height sufficient to receive beverage containers, and a means for returning drained chilled water to the water filled container located in the first mentioned enclosing cabinet.

2. An ice making and dispensing machine comprising in combination an enclosing cabinet, a water tight container constructed of high thermal transmitting material, pressurized syrup storage container, a refrigerating system including evaporator comprising metalic tubing having multiple contact points configured to contact the outer surface of the said water tight container, said water tight container being filled with water, said evaporator by means of heat transfer to produce a plurality of pure ice cubes beng circular in form and having a slight convex surface adjacent to the side wall of the water tight container upon which they form and a greater convex surface on the opposite side due to ice build up as the cubes grown to any desired thickness, a means for providing a harvesting cycle consisting of an intermittently applied hot gas flow through said evaporator causing the ice cubes to release from the interior side wall and float to the surface of the contained water producing an ice/water mixture, conduits consisting of tubing located internally of the enclosing cabinet for circulating the ice/water mixture to a dispensing head and additional tubing extending from the syrup storage containers and disposed around and in contact with the outer surface of the ice/water mixture container thus effectively cooling the syrup while being delivered to the dispensing head, a means of circulating the ice/water mixture, a means for circulating the syrup to the dispensing head, the dispensing head located within the enclosing cabinet consisting of variable flow-rate dispensing valves and attending actuating members, a control system providing for the simultaneous dispensing of multiple beverage ingredients, a delivery chute consisting of tubing extending downward from the enclosing cabinet at a height sufficient to receive beverage containers, and a means for returning drained chilled water to the said water fill container.

3. An ice making and dispensing machine comprising in combination an enclosing cabinet, a water filled carbon dioxide gas pressurized container constructed of high thermal transmitting material, pressurized syrup storage containers, a liquid refrigerant evaporator comprising metalic tubing having multiple contact points configured to contact the outer surface of said container, a refrigeration system for providing evaporator to produce carbonated ice cubes in a carbonated ice/-water mixture, a means for providing an ice harvesting cycle consisting of an intermittently applied hot gas flow to the said evaporator, conduits consisting of tubing located internally of the enclosing cabinet, a means for circulating separately the ice/water mixture and syrup to a delivery head which consists of variable flow-rate dispensing valves with attending actuating members, a control system providing for the simultaneous dispensing of multiple beverage ingredients, a delivery chute consisting of tubing extending downward from the said enclosing cabinet at a height sufficient to receive beverage containers, a means for returning drained chilled water to the said water filled pressurized containers.

4. An ice making and dispensing machine as described in claim 1 having variable flow-rate dispensing valves each consisting of a rectangular body having a small liquid passageway in one end extending one third the distance of the body, a large liquid passageway in the opposite end extending inward and connecting with the small passageway and inlet and outlet passageways extending from the sides of the body to connect with the large and small passageways, an activating rod disposed centrally of the two liquid passageways, a poppet fastened to the activating rod near its midpoint, a seat inserted in the large liquid passageway at its junction with the small liquid passageway, bushings having openings into which the activating rod is disposed at each end of the body and means for adjusting the flow-rate of the valve.

5. An ice making and dispensing machine as described in claim 4 having delayed action manually operated electrical switches each consisting of a rectangular body enclosing an electrical solenoid, electrical contact points and electrical conductors.

* * * * *

UNITED STATES PATENT AND TRADEMARK OFFICE

CERTIFICATE OF CORRECTION

PATENT NO. : 4,901,539

DATED : 02/20/90

INVENTOR(S) : Garber, Howard A. and Knutson, William P.

It is certified that error appears in the above-identified patent and that said Letters Patent is hereby corrected as shown below:

The following three words appearing in Fig. 14 sheet 2; COKE, PEPSI and SPRIT, were erroneously included on the drawings and are herewith deleted.

Signed and Sealed this

Eighteenth Day of June, 1991

*Attest:*

*Attesting Officer*

HARRY F. MANBECK, JR.

*Commissioner of Patents and Trademarks*